US009604481B2

(12) United States Patent
Yamamoto et al.

(10) Patent No.: US 9,604,481 B2
(45) Date of Patent: Mar. 28, 2017

(54) MEDIUM TRANSPORT DEVICE AND PRINTING APPARATUS PROVIDED THEREWITH

(71) Applicant: SCREEN Holdings Co., Ltd., Kyoto (JP)

(72) Inventors: Takaharu Yamamoto, Kyoto (JP); Shinsuke Yamashita, Kyoto (JP)

(73) Assignee: SCREEN Holdings Co., Ltd. (JP)

( * ) Notice: Subject to any disclaimer, the term of this patent is extended or adjusted under 35 U.S.C. 154(b) by 0 days.

(21) Appl. No.: 14/788,975

(22) Filed: Jul. 1, 2015

(65) Prior Publication Data

US 2016/0052740 A1 Feb. 25, 2016

(30) Foreign Application Priority Data

Aug. 19, 2014 (JP) ..... 2014-166765

(51) Int. Cl.

| | |
|---|---|
| ***B41J 15/04*** | (2006.01) |
| ***B65H 23/26*** | (2006.01) |
| ***B65H 20/02*** | (2006.01) |
| ***B65H 23/04*** | (2006.01) |
| ***B65H 23/038*** | (2006.01) |

(52) U.S. Cl.

CPC ..... *B41J 15/046* (2013.01); *B65H 23/038* (2013.01); *B65H 2301/3112* (2013.01); *B65H 2301/3311* (2013.01); *B65H 2404/15212* (2013.01); *B65H 2801/15* (2013.01)

(58) Field of Classification Search

CPC ..... B65H 23/26; B65H 23/048; B65H 20/02; B65H 2404/10; B41J 15/046

USPC ..... 347/104

See application file for complete search history.

(56) References Cited

U.S. PATENT DOCUMENTS

| | | | |
|---|---|---|---|
| 2002/0011170 A1 | 1/2002 | Kuwabara et al. | 101/484 |
| 2011/0211889 A1* | 9/2011 | Izumi | G03G 15/652 399/406 |

FOREIGN PATENT DOCUMENTS

| | | |
|---|---|---|
| JP | 2002-046912 | 2/2002 |

* cited by examiner

*Primary Examiner* — Stephen Meier
*Assistant Examiner* — Alexander D Shenderov
(74) *Attorney, Agent, or Firm* — Ostrolenk Faber LLP

(57) ABSTRACT

Provided is a medium transport device transporting a medium. The medium transport device includes a skew correcting mechanism disposed on a transport path for transporting a long medium, a first transport roller disposed on the transport path and transporting the medium, and a second transport roller transporting the medium to the first transport roller. The first transport roller is disposed upstream of the skew correcting mechanism. The second transport roller is disposed upstream of and next to the first transport roller. The second transport roller contacts one surface of the medium, and the first transport roller contacts the other surface of the medium.

6 Claims, 5 Drawing Sheets

Fig.7

COMPARISON OF COLOR SHIFT

SHIFT BETWEEN COLOR BLACK (K) AND YELLOW (Y)

| | PRESENT EMBODIMENT | | | CONVENTIONAL EXAMPLE | | |
|---|---|---|---|---|---|---|
| | SAMPLE 1 | SAMPLE 2 | SAMPLE 3 | SAMPLE 1 | SAMPLE 2 | SAMPLE 3 |
| 0-10m | 99 | 84 | 89 | 207 | 240 | 271 |
| 10-30m | 64 | 36 | 46 | 139 | 120 | 169 |
| 30-50m | 48 | 54 | 49 | 52 | 33 | 61 |

UNIT [$\mu$m]

MEDIUM TRANSPORT DEVICE AND PRINTING APPARATUS PROVIDED THEREWITH

TECHNICAL FIELD

The present invention relates to a medium transport device transporting a long medium and a printing apparatus provided with the medium transport device.

BACKGROUND ART

In a currently-used apparatus that performs printing onto a long medium, a print format has been switched from a transaction printing to POD (Print on Demand) printing. The transaction printing performs typical printing onto continuous-form paper. The POD printing often performs printing depending on a print medium such as exclusive paper for inkjet or coated paper. The POD printing requires printing with higher accuracy.

Some of inkjet printing apparatus include one provided with a recording unit. The recording unit has inkjet heads with nozzles in staggered arrangement for compatibility of high speed recording and high resolution. Such an apparatus may generate printed results as under. Now reference is made to FIGS. 3 to 5. FIG. 3 is a schematic view illustrating a printed result with neither skew nor serpentine. FIG. 4 is a schematic view illustrating a printed result with skew. FIG. 5 is a schematic view illustrating a printed result with serpentine.

When the printing sheet contains neither skew nor serpentine as illustrated in FIG. 3, a printing region with a given area at a certain density has no defective part and thus has only a normal part. On the other hand, when the printing sheet is skewed as illustrated in FIG. 4, a defective part is generated. The defective part includes white lines caused by non-printable portions due to clearances of the inkjet heads in the staggered arrangement, and black lines caused by overlapped nozzles of the inkjet heads in the staggered arrangement in a transportation direction. Moreover, when the printing sheet is serpentine as illustrated in FIG. 5, the following detective parts are generated. That is, the defective parts include a defective part with white and black lines that are the same as that in the skewed printing sheet, a normal part, and a defective part in which the white and black lines are transposed due to serpentine in an opposite direction.

Consequently, the following has been suggested. See, for example, Japanese Unexamined Patent Publication No. 2002-46912A. That is, transport rollers transport a long print medium, and a skew correcting mechanism corrects skew of the print medium. Thereafter, an image generator disposed downstream of the skew correcting mechanism generates an image on the print medium.

However, the conventional example with such a configuration has the following drawbacks.

That is, the currently-used apparatus includes the skew correcting mechanism. Consequently, this suppresses skew of the printing sheet, and thus a printing defect caused by the skew are unlikely to occur. On the other hand, the skew correcting mechanism has no function of attenuating serpentine. This causes a printing defect caused by the serpentine. Accordingly, two transport rollers are combined to generate an S-shaped pass that allows serpentine attenuation, and the S-shaped pass is disposed downstream of the skew correcting mechanism. However, such a configuration may cause the following drawback. That is, large skew may occur depending on parallelism of the two transport rollers of the S-shaped pass, leading to possibility of the printing defect caused by the skew.

Other types of apparatus except for the printing apparatus may possess the drawback of the skew and/or serpentine generated upon transportation of the long medium.

SUMMARY OF INVENTION

The present invention has been made regarding the state of the art noted above, and its one object is to provide a medium transport device and a printing apparatus provided with the medium transport device that allows attenuation of serpentine and skew by devising a transportation path to achieve enhanced transportation accuracy.

In order to accomplish the above object, the present invention adopts the following construction.

One embodiment of the present invention discloses a medium transport device transporting a medium. The medium transport device includes a skew correcting mechanism disposed on a transport path for transporting a long medium; a first transport roller disposed on the transport path and transporting the medium; and a second transport roller disposed upstream of the first transport roller and transporting the medium to the first transport roller. The first transport roller is disposed upstream of the skew correcting mechanism. The second transport roller is disposed upstream of and next to the first transport roller. The second transport roller contacts one surface of the medium. The first transport roller contacts the other surface of the medium.

With the embodiment of the present invention, the first transport roller is disposed upstream of the skew correcting mechanism having a function of attenuating skew. The second transport roller is disposed next to the first transport roller. The second transport roller contacts one surface of the print medium. The first transport roller contacts the other surface of the print medium. A path configured in such a manner (also referred to as an S-shaped path) allows attenuation of serpentine. Consequently, the serpentine of the medium transported on the transport path is attenuated, and thereafter the skew is attenuated with the skew correcting mechanism. This allows attenuation of both the serpentine and the skew of the medium, leading to enhanced transportation accuracy.

It is preferable that the second transport roller of the present invention has a winding angle of 90 degrees or more.

A large winding angle of the second transport roller achieves a high attenuation rate of the serpentine. Accordingly, the serpentine of the medium can be attenuated largely. This allows more enhanced transportation accuracy.

Moreover, it is preferable that the embodiment of the present invention further includes a third transport roller disposed downstream of and next to the second transport roller.

The third transport roller allows high flexibility of arrangement of the second roller with a large winding angle of the second transport roller.

Moreover, it is preferable that the second transport roller of the present invention is disposed at a pitch of more than a diameter of the first transport roller to 1.5 times the diameter from a rotation center of the first transport roller.

The first transport roller is disposed adjacent to the second transport roller. This ensures an effect of attenuating the serpentine.

Moreover, it is preferable in the embodiment of the present invention that the first transport roller and the second transport roller are disposed in a vertical direction.

The first transport roller and the second transport roller are disposed in the vertical direction. This allows a suppressed length of the apparatus, achieving reduction in size of the apparatus.

Moreover, another embodiment of the present invention discloses a printing apparatus performing printing onto a print medium. The apparatus includes a skew correcting mechanism disposed on a transport path for transporting a long print medium; a first transport roller disposed on the transport path and transporting the print medium; a second transport roller disposed downstream of the first transport roller and transporting the print medium to the first transport roller; and a recording unit disposed downstream of the skew correcting mechanism and recording an image to the print medium. The first transport roller is disposed upstream of the skew correcting mechanism. The second transport roller is disposed upstream of and next to the first transport roller. The second transport roller contacts one surface of the print medium. The first transport roller contacts the other surface of the print medium.

With the embodiment of the present invention, the first transport roller is disposed upstream of the skew correcting mechanism having a function of attenuating the skew, and the second transport roller is disposed next to the first transport roller. The second transport roller contacts one surface of the print medium. The first transport roller contacts the other of the print medium. A path configured in such a manner (also referred to as an S-shaped path) allows attenuation of serpentine. Consequently, the serpentine of the print medium transported on the transport path is attenuated, and thereafter, the skew is attenuated with the skew correcting mechanism. This allows attenuation of both the serpentine and the skew of the print medium, leading to an enhanced printing accuracy onto the print medium by the recording unit disposed downstream of the skew correcting mechanism.

BRIEF DESCRIPTION OF DRAWINGS

For the purpose of illustrating the invention, there are shown in the drawings several forms which are presently preferred, it being understood, however, that the invention is not limited to the precise arrangement and instrumentalities shown.

FIG. 7 is a table illustrating comparison of a color shift between the embodiment and the conventional example.

DESCRIPTION OF EMBODIMENTS

The following describes in detail preferred embodiments of the present invention with reference to drawings.

Figure 1:
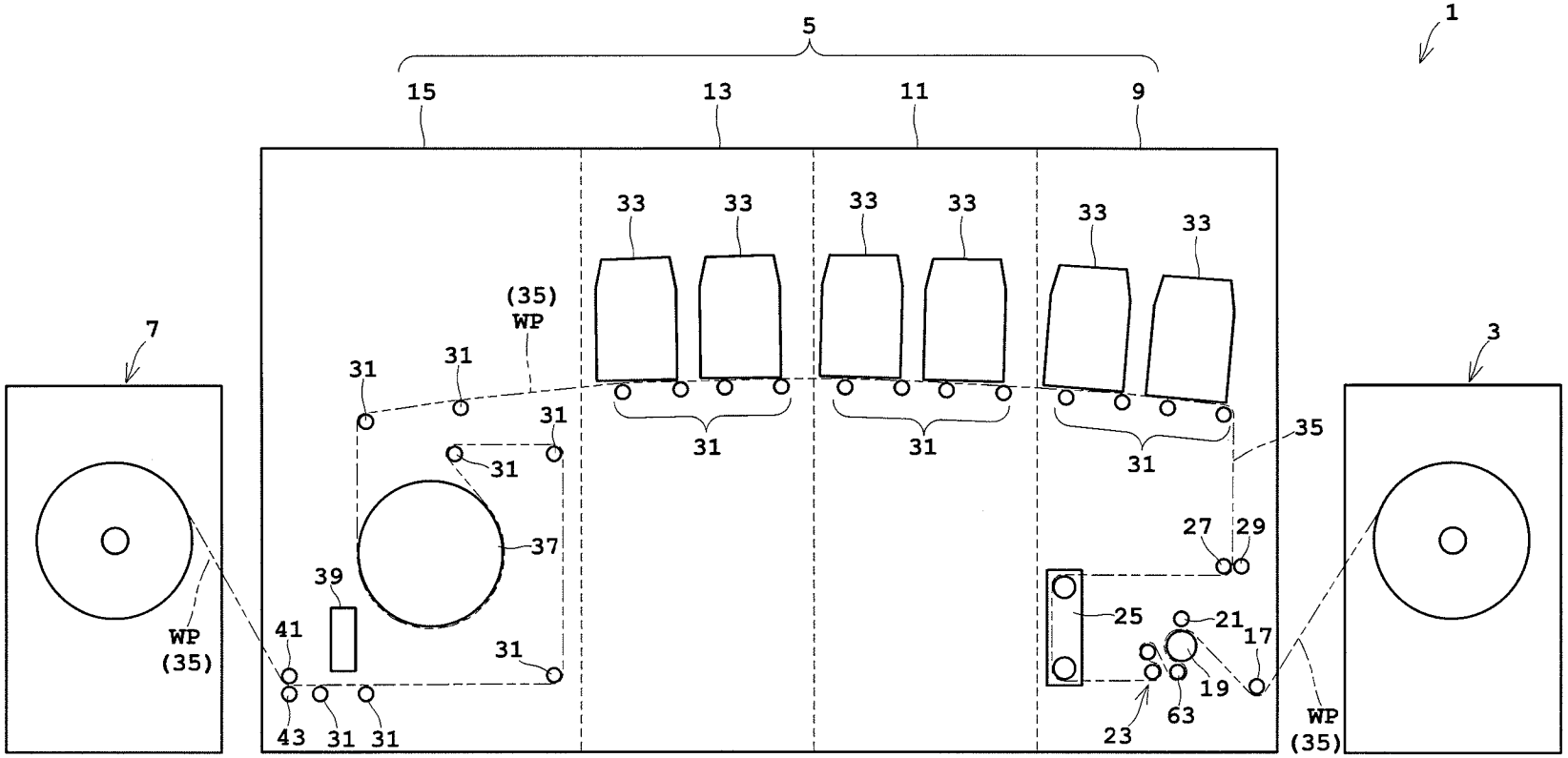
FIG. 1 is a schematic side view of an inkjet printing system according to one embodiment of the present invention.

FIG. 1 is a schematic side view of an inkjet printing system according to one embodiment of the present invention.

The inkjet printing system 1 according to the present embodiment includes a paper feeder 3, an inkjet printing apparatus 5, and a take-up roller 7.

The paper feeder 3 holds long web paper WP in a roll form to be rotatable about a horizontal axis. The paper feeder 3 unwinds and feeds the web paper WP to the inkjet printing apparatus 5.

The paper feeder 3 holds the web paper WP to be rotatable about the horizontal axis. The paper feeder 3 unwinds and feeds the web paper WP to the inkjet printing apparatus 5. The inkjet printing apparatus 5 performs printing onto the web paper WP received from the paper feeder 3. The take-up roller 7 winds up the web paper WP printed by the inkjet printing apparatus 5 about the horizontal axis. Regarding the side from which the web paper WP is fed as upstream and the side to which the web paper WP is fed out as downstream, the paper feeder 3 is disposed upstream of the inkjet printing apparatus 5, whereas the take-up roller 7 is disposed downstream of the inkjet printing apparatus 5.

Here, the web paper WP corresponds to the "medium" in the present invention.

The inkjet printing apparatus 5 includes an inlet unit 9, a first intermediate unit 11, a second intermediate unit 13, and an outlet unit 15, in this order, from a side adjacent to the paper feeder 3. The inkjet printing apparatus 5 is formed by the above units 9, 11, 13, and 15 selectively connected as appropriate.

The inlet unit 9 includes a drive roller 17, a drive roller 19, a nip roller 21, an S-shaped path unit 23, an edge position controller 25, a drive roller 27, a nip roller 29, four transport rollers 31, and two recording units 33, in this order, from the side adjacent to the paper feeder 3. The drive roller 19 and the nip roller 21 take up the web paper WP from the paper feeder 3, and feed the web paper WP to the recording units 33. The S-shaped path unit 23 transports the web paper WP in an alphabet S shape, which is to be mentioned later in detail. The edge position controller 25 corrects a position of the web paper WP automatically when the web paper WP skews in a width direction, whereby the web paper WP is transported correctly. The four transport rollers 31 form a transport path 35 indicated in the same position as that of the web paper WP in the drawing. The transport rollers 31 contact a lower surface of the web paper WP for smoothly transporting the web paper WP along the transport path 35. The recording units 33 each discharge ink droplets to the web paper WP to form a printed image. Here, the two recording units 33 discharge ink droplets in black (K) and cyan (C) individually.

The edge position controller 25 corresponds to the "skew correcting mechanism" in the present invention.

The first intermediate unit 11 includes the four transport rollers 31 and the two recording units 33. The recording units 33 discharge ink droplets in magenta (M) and yellow (Y) individually.

The second intermediate unit 13 has the same construction as the first intermediate unit 11 mentioned above. That is, the second intermediate unit 13 includes four transport rollers 31 and two recording units 33. Upstream one of the two recording units 33 discharges ink droplets in gold, and the other downstream one discharges an overcoating agent.

The outlet unit 15 includes a transport roller 31, a heat drum 37, a transport roller 31, an inspecting unit 39, a drive roller 41, and a nip roller 43, in this order, from the upstream of the transport path. The heat drum 37 contains a heater embedded therein. The heat drum 37 rotates in association with the transportation of the web paper WP. The heat drum 37 dries the ink droplets discharged on the web paper WP through heating. The inspecting unit 39 inspects the printed image on the surface of the web paper WP for any printing defect, such as stains or omissions.

Figure 2:
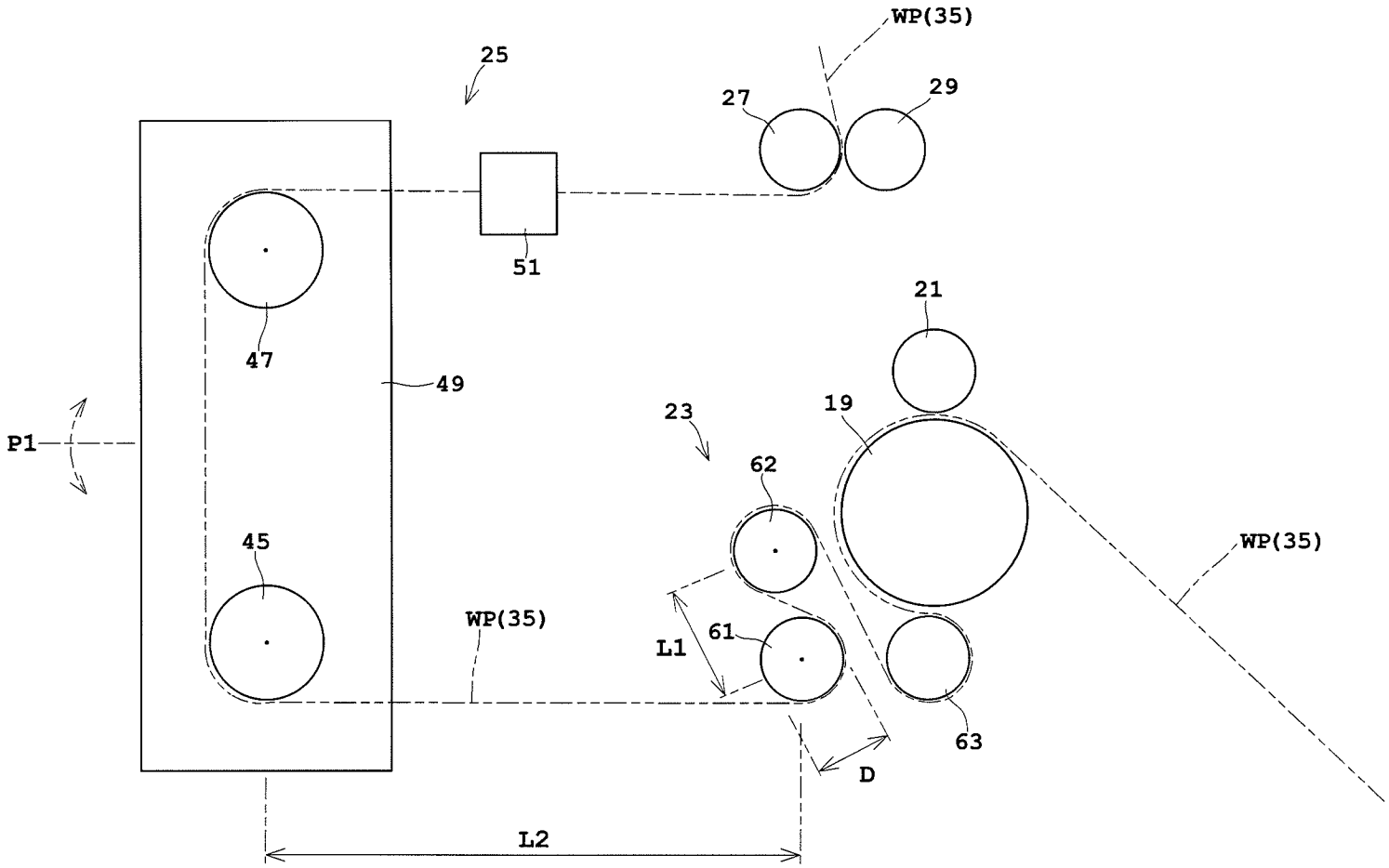
FIG. 2 is a partially-enlarged side view of a transport path of the embodiment.

Now reference is made to FIG. 2. FIG. 2 is a partially-enlarged side view of the transport path.

The edge position controller 25 automatically corrects a position of the web paper WP when the web paper WP skews in the width direction, whereby the web paper WP is transported correctly. Specifically, the edge position controller 25 includes two position regulation rollers 45, 47, a frame 49 holding the position regulation rollers, and an edge sensor 51. The two position regulation rollers 45, 47 are rotatably attached to the frame 49 in parallel. The frame 49 swings in synchronization with the position regulation rollers 45, 57 about a pivot axis P1 for regulating an edge position of the web paper WP (also referred to as a selvedge). An extent of the regulation is determined in accordance with signals from the edge sensor 51. This causes the edge position controller 25 to regulate the edge position of the web paper WP for achieving suppressed skew.

The edge position controller 25 includes the S-shaped path unit 23 disposed upstream thereof. The S-shaped path unit 23 includes a first transport roller 61, a second transport roller 62, and third transport roller 63 in this order from upstream of the edge position controller 25 to the drive roller 19. The first transport roller 61 is disposed at almost the same level as that of the position regulation roller 45. The second transport roller 62 is disposed above and adjacent to the first transport roller 61. Here, the second transport roller 62 is spaced away from the second transport roller 62. In other words, the first transport roller 61 and the second transport roller 62 are disposed in a vertical positional relationship. The second transport roller 62 contacts one surface of the web paper WP, and the first transport roller 61 contacts the other surface of the web paper WP. That is, the first transport roller 61 and the second transport roller 62 are so arranged that the transport path 35 is configured in an S-shape. The third transport roller 63 changes a direction of the web paper WP fed from the upstream nip roller 21, and feeds the web paper WP to the second transport roller 62 so as for the second transport roller 62 to have a winding angle of 90 degrees or more. Here in the present embodiment, a winding angle of the first transport roller 61 is also set to be 90 degrees or more.

The second transport roller 62 is disposed adjacent to the first transport roller 61 by a distance L1. The distance L1 is a pitch of more than a diameter D of the first transport roller 61 to 1.5 times the diameter from the rotation center of the first transport roller 61. The S-shaped path unit 23 is configured such that the first transport roller 61 and the second transport roller 62 rotate in directions opposite to each other, and are disposed relatively close to each other. Consequently, even with low parallelism of the first transport roller 61 and the second transport roller 62, the skew generated at the second transport roller 62 is compensated with the skew generated at the first transport roller 61 rotating in the direction opposite to the second transport roller 62. This allows attenuation of the skew of the web paper WP in the S-shaped path unit 23.

Moreover, the first transport roller 61 is disposed downstream of the position regulation roller 45 of the edge position controller 25 by a distance L2. The distance L2 is, for example, around a paper width of the web paper WP.

Figure 3:
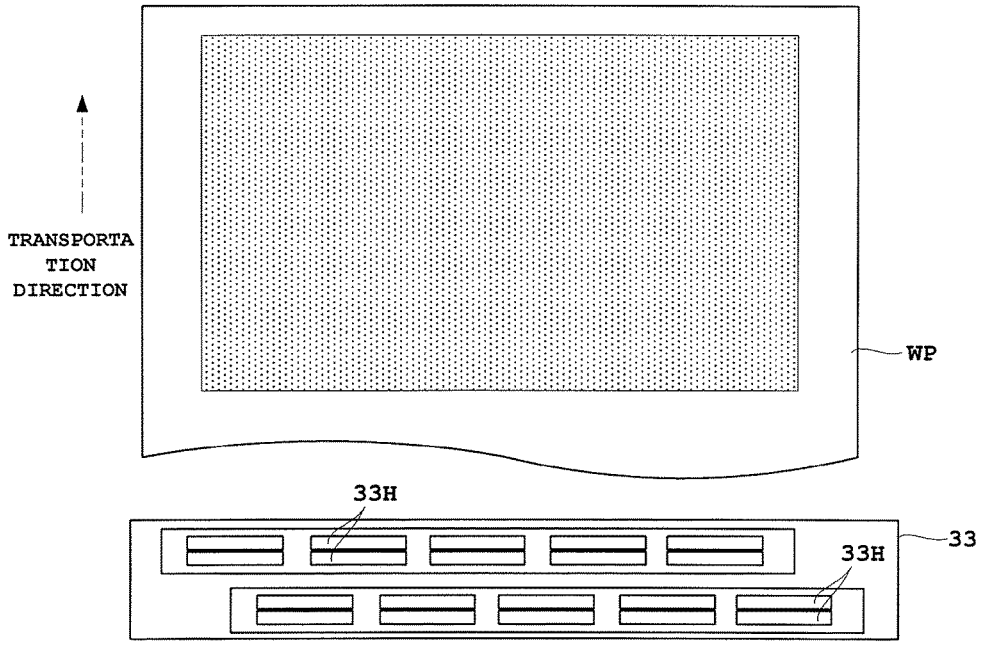
FIG. 3 is a schematic view of a printed result with neither skew nor serpentine.
Figure 4:
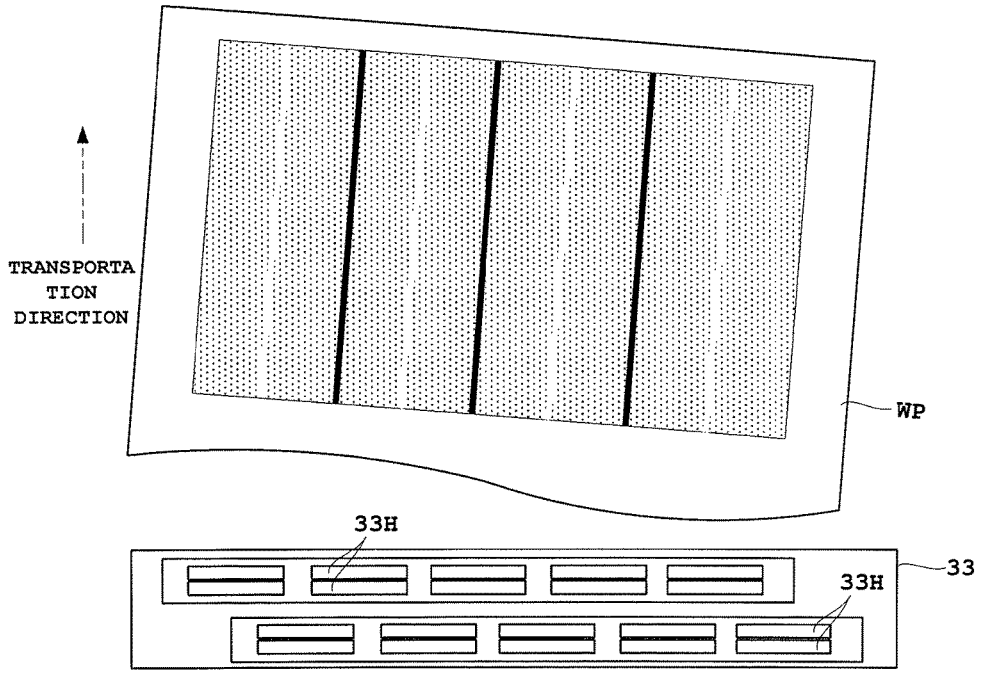
FIG. 4 is a schematic view of a printed result with skew.
Figure 5:
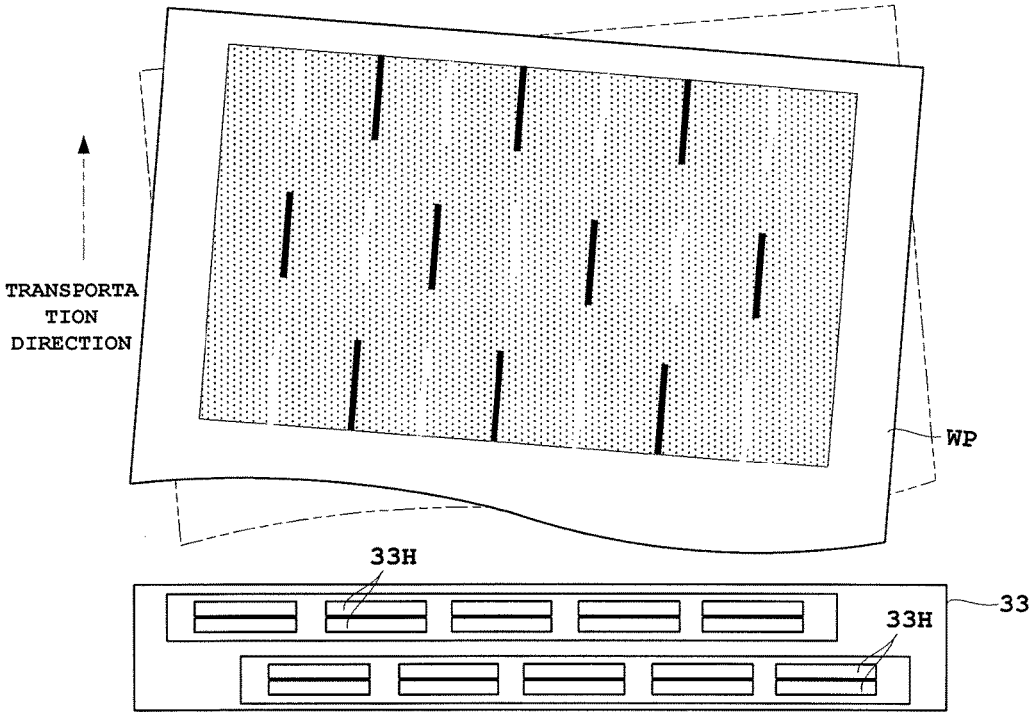
FIG. 5 is a schematic view of a printed result with serpentine.

Now reference is made to FIGS. 3 to 5. FIG. 3 is a schematic view illustrating a printed result with neither skew nor serpentine. FIG. 4 is a schematic view illustrating a printed result with skew. FIG. 5 is a schematic view illustrating a printed result with serpentine.

As mentioned above, the paper feeder 3 feeds the web paper WP, and the recording units 33 perform printing onto the web paper WP. The recording units 33 each include a plurality of inkjet heads 33H with nozzles. The inkjet heads 33H are in staggered arrangement. Consequently, under no skewed or serpentine condition, the recording units 33 perform printing with no defective part onto a certain area at a constant density as illustrated in FIG. 3. On the other hand, under a skewed condition, clearances of the inkjet heads 33H in the staggered arrangement cause non-printable portions as white lines. Moreover, overlapped portions of the nozzles of the inkjet heads 33H in the staggered arrangement in the transportation direction cause portions as black lines. Such the while and black lines lead to a printing defect. Moreover, under a serpentine condition, other defective parts are generated. The defective parts include a defective part with white and black lines that are the same as that in the skewed condition, a normal part, and a defective part in which the white and black lines are transposed due to serpentine in an opposite direction.

However, the present embodiment allows suppression of the printing defect. Specifically, in the present embodiment, the first transport roller 61 is disposed upstream of the edge position controller 25 having a function of attenuating skew, and the second transport roller 62 is disposed upstream of and next to the first transport roller 61. The second transport roller 62 contacts one surface of the web paper WP, and the first transport roller 61 contacts the other surface of the web paper WP. The S-shaped path having such a configuration allows attenuation of the serpentine of the web paper WP. Consequently, the serpentine of the web paper WP transported on the transport path 35 is attenuated, and thereafter, the skew is attenuated with the edge position controller 25. This allows attenuation of both the serpentine and the skew of the web paper WP, leading to an enhanced printing accuracy to the web paper WP by the recording units 33 disposed downstream of the edge position controller 25.

Moreover, the second transport roller 62 has a large winding angle of 90 degrees or more for suppression in slide of the web paper WP. This allows a high attenuation rate of the serpentine. As a result, more attenuated serpentine of the web paper WP is obtained, causing more enhanced printing accuracy. Moreover, the third transport roller 63 is disposed upstream of the second transport roller 62. This allows high flexibility of arrangement of the second transport roller 62 with the large winding angle of the second transport roller 62.

Moreover, the first transport roller 61 is disposed adjacent to the second transport roller 62 by the distance L1. This ensures an effect of attenuating the serpentine. Moreover, the first transport roller 61 and the second transport roller 62 are disposed in the vertical direction. This allows a suppressed length of the apparatus, achieving reduction in size of the apparatus.

Figure 6:
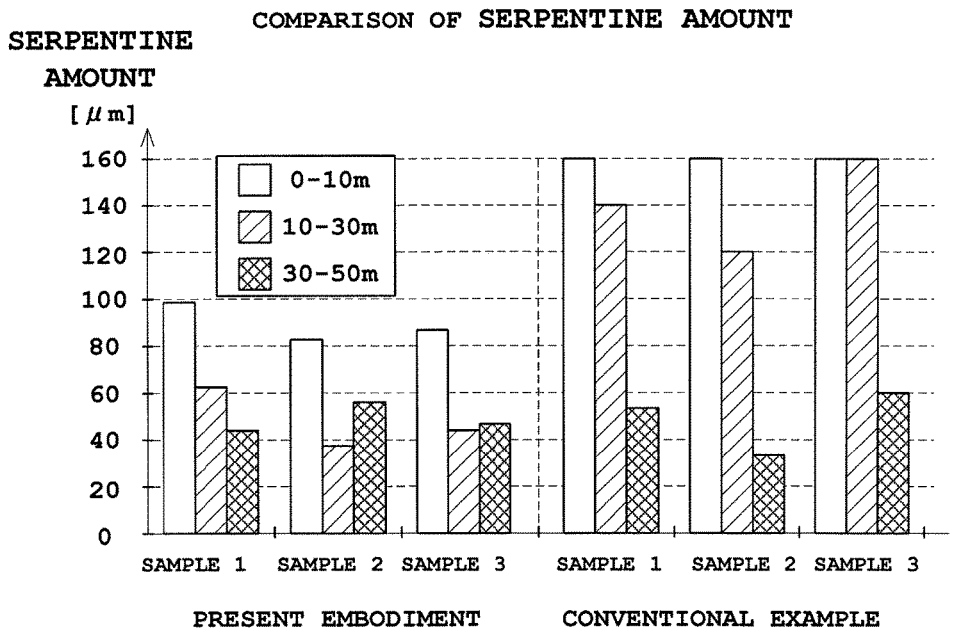
FIG. 6 is a graph illustrating comparison of a serpentine amount between the embodiment and a conventional example.

Now reference is made to FIGS. 6 and 7. FIG. 6 is a graph illustrating comparison of a serpentine amount between the embodiment and the conventional example. FIG. 7 is a table illustrating comparison of a color shift between the embodiment and the conventional example. Here, the conventional example includes no S-shaped path unit 23 mentioned above upstream of the edge position controller 25.

It is revealed from FIG. 6 that serpentine amounts are each extremely smaller in the embodiment than in the conventional example. Here, the serpentine is corrected gradually while the web paper WP is fed. Accordingly, a first 0 to 10 m part of the web paper WP has a larger serpentine amount than a subsequent 30 to 50 m part of the web paper WP.

It is revealed from FIG. 7 that color shifts are each extremely lower in the embodiment than in the conventional example. The same reason is applicable to the feature that a first 0 to 10 m part of the web paper WP has a large color shift amount than a subsequent 30 to 50 m part of the web paper WP.

The present invention is not limited to the foregoing examples, but may be modified as follows.

(1) The embodiment has been described taking the inkjet printing apparatus 5 as one example. Alternatively, the present invention is applicable to other types of printing apparatus, such as a laser type printing apparatus, that perform printing onto a long print medium.

(2) In the embodiment mentioned above, the web paper WP has been described as one example of the medium. However, the present invention is not only applicable to the web paper WP. The present invention is also applicable to other types of print medium with a long length. For instance, examples of the print medium include a film used for manufacturing fuel cells.

(3) In the embodiment mentioned above, a plurality of recording units 33 are provided, and the units 9, 11, 13, and 15 may be combined flexibly. However, such a configuration is not essential to the present invention.

(4) In the embodiment mentioned above, the S-shaped path unit 23 includes the third transport roller 63. However, the third transport roller 63 is not essential in the present invention. The S-shaped path unit 23 may be formed by only the first transport roller 61 and the second transport roller 62.

(5) In the embodiment mentioned above, the first transport roller 61 and the second transport roller 62 of the S-shaped path unit 23 are disposed in the vertical direction. However, the present invention is not limited to such arrangement. For instance, the first transport roller 61 and the second transport roller 62 arranged in a horizontal direction can also produce the same effect.

(6) In the embodiment mentioned above, the edge position controller 25 has been described as one example of the mechanism correcting the skew. The present invention is not limited to this. That is, any configuration is adoptable that allows regulation of the edge position with a head-swinging type that swings both edges of the web paper WP.

The present invention may be embodied in other specific forms without departing from the spirit or essential attributes thereof and, accordingly, reference should be made to the appended claims, rather than to the foregoing specification, as indicating the scope of the invention.

What is claimed is:

1. A medium transport device transporting a medium, the medium transport device comprising:

a skew correcting mechanism disposed on a transport path for transporting a long medium, the skew correcting mechanism having a first position regulation roller upstream in a transportation direction of the medium and a downstream second position regulation roller being attached thereto in a freely rotatable manner;

the skew correcting mechanism also including a first transport roller transporting the medium and disposed on the transport path such that the medium is wound at an angle of approximately 90 degrees on the first position regulation roller of the skew correcting mechanism, and such that a winding angle of the medium on the first transport roller is 90 degrees or more; and a second transport roller disposed upstream of the first transport roller and transporting the medium to the first transport roller with a winding angle of the medium of 90 degrees or more on the second transport roller, the first transport roller being disposed upstream of the first position regulation roller, the second transport roller being disposed upstream of and next to the first transport roller at a pitch between rotation centers of the first and second transport rollers of more than a diameter of the first transport roller to 1.5 times the diameter of the first transport roller, and the second transport roller contacting one surface of the medium, and the first transport roller contacting the other surface of the medium.

2. The medium transport device according to claim 1, further comprising:

a third transport roller disposed upstream of and next to the second transport roller.

3. The medium transport device according to claim 2, wherein the first transport roller and the second transport roller are disposed in a vertical direction.

4. The medium transport device according to claim 1, wherein the first transport roller and the second transport roller are disposed in a vertical direction.

5. A printing apparatus performing printing onto a print medium, the apparatus comprising:

a skew correcting mechanism disposed on a transport path for transporting a long print medium, the skew correcting mechanism having a first position regulation roller upstream in a transportation direction of the medium and a downstream second position regulation roller being attached thereto in a freely rotatable manner;

the skew correcting mechanism also including a first transport roller transporting the medium and disposed on the transport path such that the medium is wound at an angle of approximately 90 degrees on the first position regulation roller of the skew correcting mechanism, and such that a winding angle of the medium on the first transport roller is 90 degrees or more;

a second transport roller disposed upstream of the first transport roller and transporting the print medium to the first transport roller with a winding angle of the medium of 90 degrees or more on the second transport roller; and a recording unit disposed downstream of the skew correcting mechanism and recording an image to the print medium, the first transport roller being disposed upstream of the first position regulation roller, the second transport roller being disposed upstream of and next to the first transport roller at a pitch between rotation centers of the first and second transport rollers of more than a diameter of the first transport roller to 1.5 times the diameter of the first transport roller, and the second transport roller contacting one surface of the print medium, and the first transport roller contacting the other surface of the print medium.

6. The printing apparatus according to claim 5, further comprising:

a third transport roller disposed upstream of and next to the second transport roller.

* * * * *